US008834062B1

(12) United States Patent
Schmidt

(10) Patent No.: US 8,834,062 B1
(45) Date of Patent: Sep. 16, 2014

(54) APPARATUS AND METHOD FOR PICKING UP AND REPOSITIONING A STRING OF ROADWAY BARRIER SEGMENTS

(71) Applicant: Kevin L. Schmidt, Rio Vista, CA (US)

(72) Inventor: Kevin L. Schmidt, Rio Vista, CA (US)

(73) Assignee: Lindsay Transportation Solutions, Inc., Omaha, NE (US)

( * ) Notice: Subject to any disclaimer, the term of this patent is extended or adjusted under 35 U.S.C. 154(b) by 67 days.

(21) Appl. No.: 13/790,765

(22) Filed: Mar. 8, 2013

(51) Int. Cl.
*E01C 19/00* (2006.01)
*E01C 19/52* (2006.01)

(52) U.S. Cl.
CPC ..... *E01C 19/006* (2013.01); *E01C 19/52* (2013.01)
USPC ..... 404/73; 404/85; 414/460

(58) Field of Classification Search
CPC ..... E01C 19/52
USPC ..... 404/6, 73, 85; 414/749.1, 749.6
See application file for complete search history.

(56) References Cited

U.S. PATENT DOCUMENTS

| | | | | |
|---|---|---|---|---|
| 5,052,854 | A | 10/1991 | Correa et al. | |
| 5,253,951 | A | 10/1993 | Peek | |
| 5,549,412 | A | 8/1996 | Malone | |
| 6,022,168 | A | 2/2000 | Junker | |
| 6,220,780 | B1 | 4/2001 | Schindler et al. | |
| 8,109,692 | B2 * | 2/2012 | Welch et al. | 404/86 |
| 8,348,546 | B2 * | 1/2013 | Welch et al. | 404/73 |
| 2010/0202829 | A1 | 8/2010 | Gelfand et al. | |
| 2010/0215433 | A1 | 8/2010 | Fritz | |

FOREIGN PATENT DOCUMENTS

| | | |
|---|---|---|
| EP | 1319757 | 6/2003 |
| FR | R82782331 | 2/2000 |

* cited by examiner

*Primary Examiner* — Raymond W Addie
(74) *Attorney, Agent, or Firm* — Thomas R. Lampe

(57) ABSTRACT

The invention relates to a method and an apparatus for automatically guiding a machine that picks up and places roadway barrier segments using satellite global positioning and ultrasonic sensors. The machine is guided by both GPS signals and signals based on ultrasonic measurement of distance from the existing barrier segments.

14 Claims, 5 Drawing Sheets

| |
|---|
| Fig. 4A |
| Fig. 4B |
| Fig. 4C |

APPARATUS AND METHOD FOR PICKING UP AND REPOSITIONING A STRING OF ROADWAY BARRIER SEGMENTS

TECHNICAL FIELD

This invention relates to an apparatus and a method employed to pick up a string of roadway barrier segments at one location and relocate the string at a second location. More particularly, the invention employs a system for automatically guiding a machine that picks up and places the roadway barrier segments.

BACKGROUND OF THE INVENTION

It is well known to use self-powered wheeled machines to pick up and move roadway barrier segments disposed end-to-end from one location or another. Some of these roadway barrier moving machines move along a string of roadway barrier segments, lift the string and transfer the string to another location through the use of a conveyor. One example of such a barrier transfer machine is manufactured by Lindsay Transportation Solutions, 180 River Road, Rio Vista, Calif. and made available under the Barrier Systems and Quick Change trademarks. Barrier transfer machines are steered and operated either solely by manual control or manual control in conjunction with infrastructure modifications such as above or below grade guide wires or magnetic tape.

As will be discussed in greater detail below, the system of this invention automatically guides a machine that picks up and places roadway barrier segments using global satellite positioning (GPS) and ultrasonic technologies. The machine is guided by both GPS signals and signals based on ultrasonic measurements from the existing barrier segments.

It is known, of course, to guide vehicles generally based on GPS sensing and also generally based on ultrasonic sensing of some type. Examples of such guidance systems are shown in the following prior art: U.S. Pat. No. 5,549,412, issued Aug. 27, 1996, U.S. Patent Application Pub. No. US 2010/0215433, published Aug. 26, 2010, U.S. Pat. No. 5,052,854, issued Oct. 1, 1991, U.S. Patent Application Pub. No. US 2010/0202829, published Aug. 12, 2010, U.S. Pat. No. 6,220,780, issued Apr. 24, 2001, U.S. Pat. No. 6,022,168, issued Feb. 8, 2000, U.S. Pat. No. 5,253,951, issued Oct. 19, 1993, French Patent No. R2782331A1, issued Feb. 18, 2000 and European Patent No. EP1319757A2, issued Jun. 18, 2003.

DISCLOSURE OF INVENTION

In the present invention the approaches of GPS sensing and ultrasonic sensing cooperate in a unique manner to perform specific tasks in association with structural features of roadway barriers and roadway barrier placement equipment.

The apparatus of the invention moves relative to a string of roadway barrier segments disposed end-to-end at a first location and during movement serially picks up roadway barrier segments of the string and transports the picked-up roadway barrier segments to relocate the string at a second location.

The apparatus includes a wheeled machine having an inlet receiving the string of roadway barrier segments at the first location.

An ultrasonic sensor is mounted on the wheeled machine for sensing the location of the string at the first location relative to the wheeled machine.

A first steering control is operatively associated with the ultrasonic sensor and with wheels of the machine to steer the wheels operatively associated therewith and maintain the inlet positioned to serially receive the roadway barrier segments at the first location.

A GPS receiver is mounted on the wheeled machine for sensing the location of the machine relative to a predetermined path of movement.

A second steering control is operatively associated with the GPS receiver and with wheels of the wheeled machine to steer the wheels operatively associated therewith and maintain movement of the wheeled machine along the predetermined path of movement when depositing the picked-up barrier segments to relocate the string at the second location.

The invention also encompasses a method of relocating a string of roadway barrier segments disposed end-to-end from a first location to a second location employing a moving wheeled machine having an inlet to serially pick up roadway barrier segments of the string and transport the picked-up roadway barrier segments to relocate the string at the second location. The method incorporates steps utilizing ultrasonic and GPS sensor systems.

Other features, advantages and objects of the present invention will become apparent with reference to the following description and accompanying drawings.

BEST MODE FOR CARRYING OUT THE INVENTION

Figure 1:
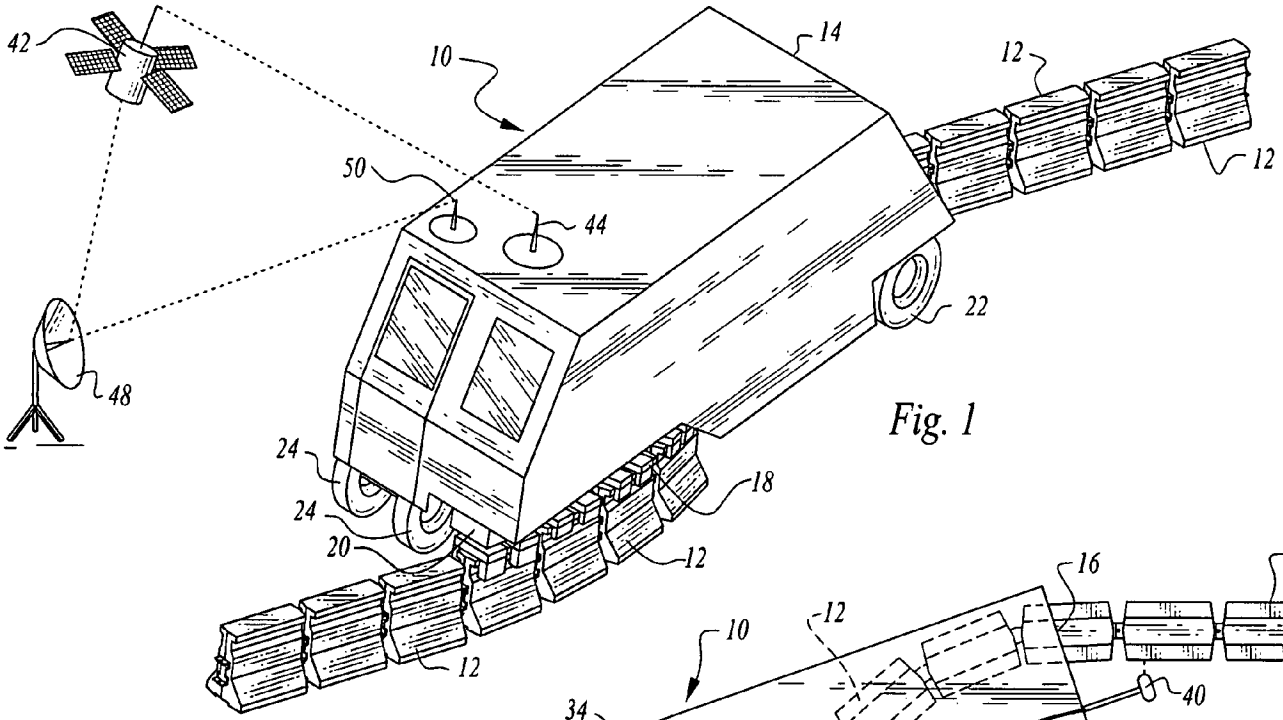
FIG. 1 is a perspective view illustrating a self-propelled wheeled machine picking up and transporting to another location a string of roadway barrier segments, elements of the GPS guidance system employed in the invention being illustrated schematically.

Referring now to the drawings, apparatus 10 constructed in accordance with the teachings of the present invention is illustrated. The apparatus moves relative to a string of roadway barrier segments 12 disposed end-to-end at a first location which may, for example, be an off road location. During movement of the apparatus the roadway barrier segments of the string are picked-up and transported to relocate the string at a second location, which may, for example, be a location on a roadway.

Figure 2:
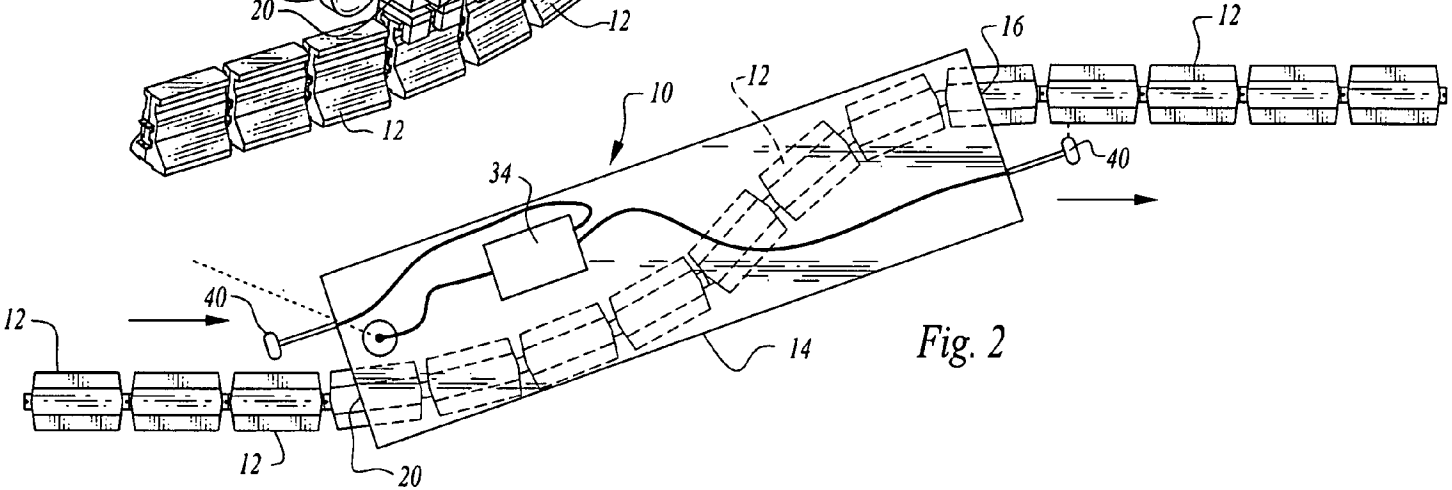
FIG. 2 is a diagrammatic, plan view of the vehicle and string being transferred thereby.

Apparatus 10 includes a wheeled, self-propelled machine 14 having an inlet 16 receiving the string of roadway barrier segments at the first location. FIG. 2 illustrates by means of arrows movement of the wheeled machine, the right end of the machine being the leading or pick-up end and the left end of the machine being the following or discharge end. As indicated above, machines of this type are known, the Quick-change barrier transfer machine made available by the Barrier Systems unit of Lindsay Transportation Solutions being an example. In the machine the string of roadway barrier segments passes through an inlet opening formed by a "snout" at the leading end of the machine whereupon the roadway barrier segments are picked-up and moved by a conveyor, such as conveyor 18 shown in FIG. 1, and delivered from an exit 20 at the discharge end of the machine offset from the snout inlet.

Figure 3:
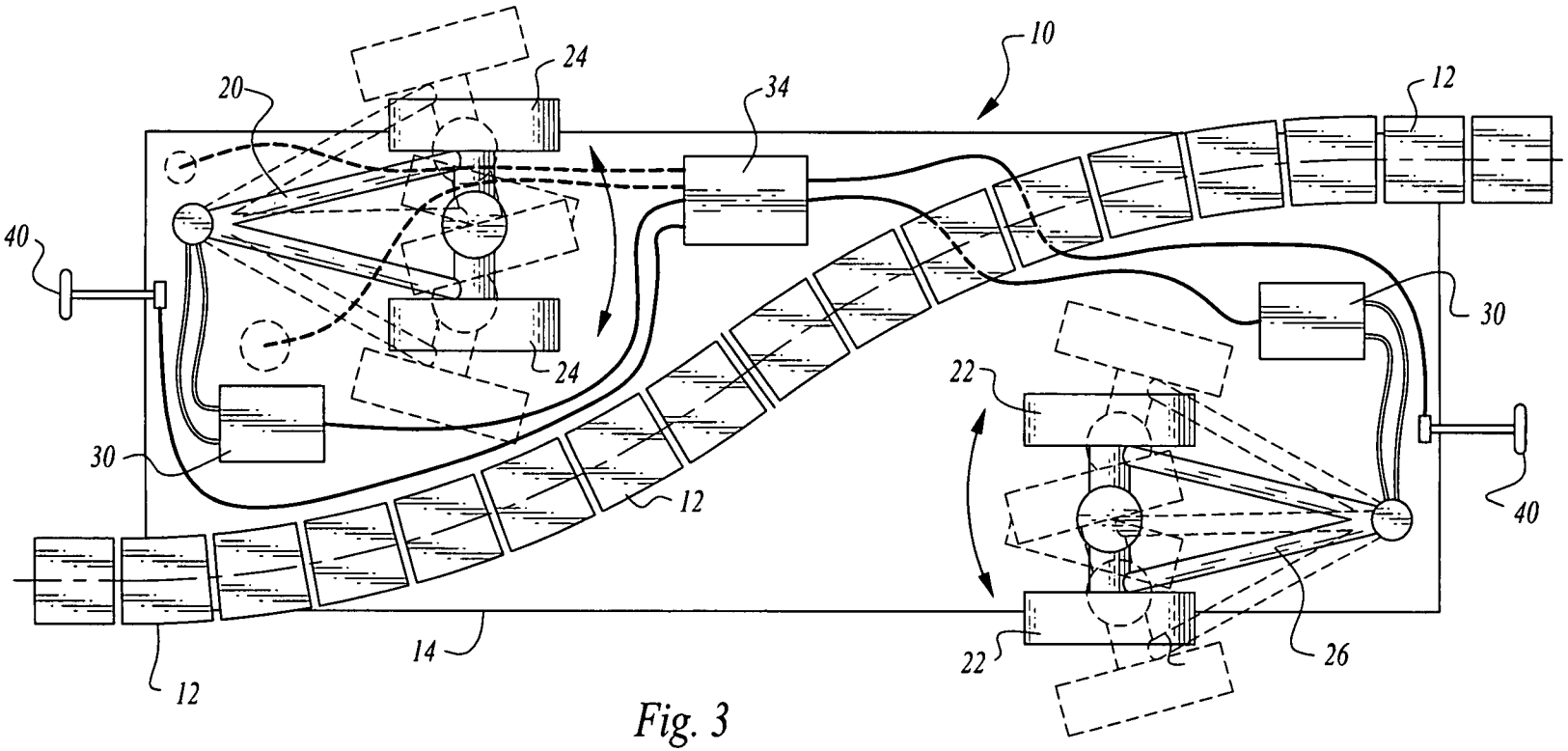
FIG. 3 is an enlarged, plan, diagrammatic view illustrating steering of vehicle wheels under the control of signals received from GPS and ultrasonic systems.
Figures 4, 4A:
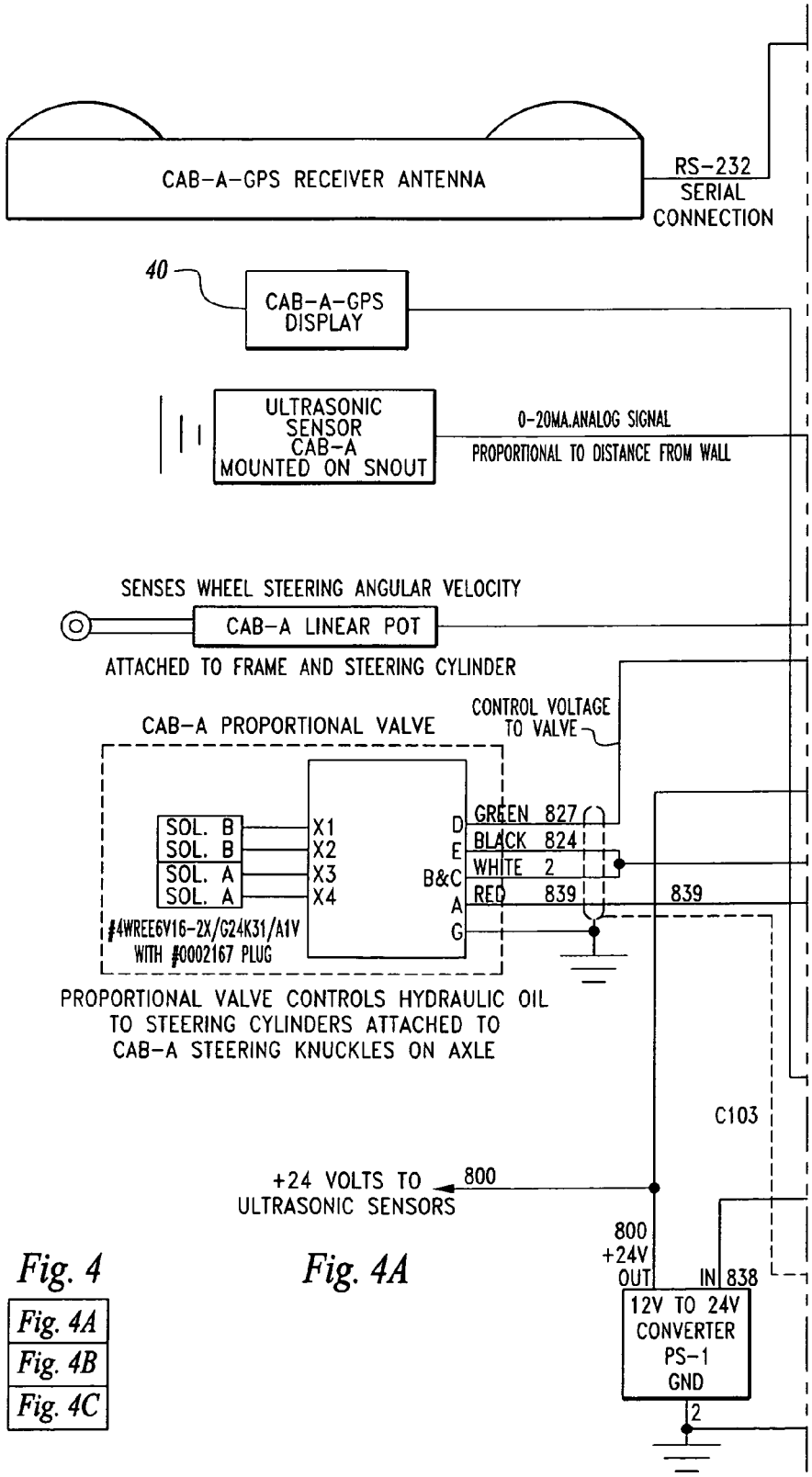
FIGS. 4 (4A, 4B and 4C) is a schematic diagram relating to the control circuitry of the apparatus of the invention.
Figure 4B:
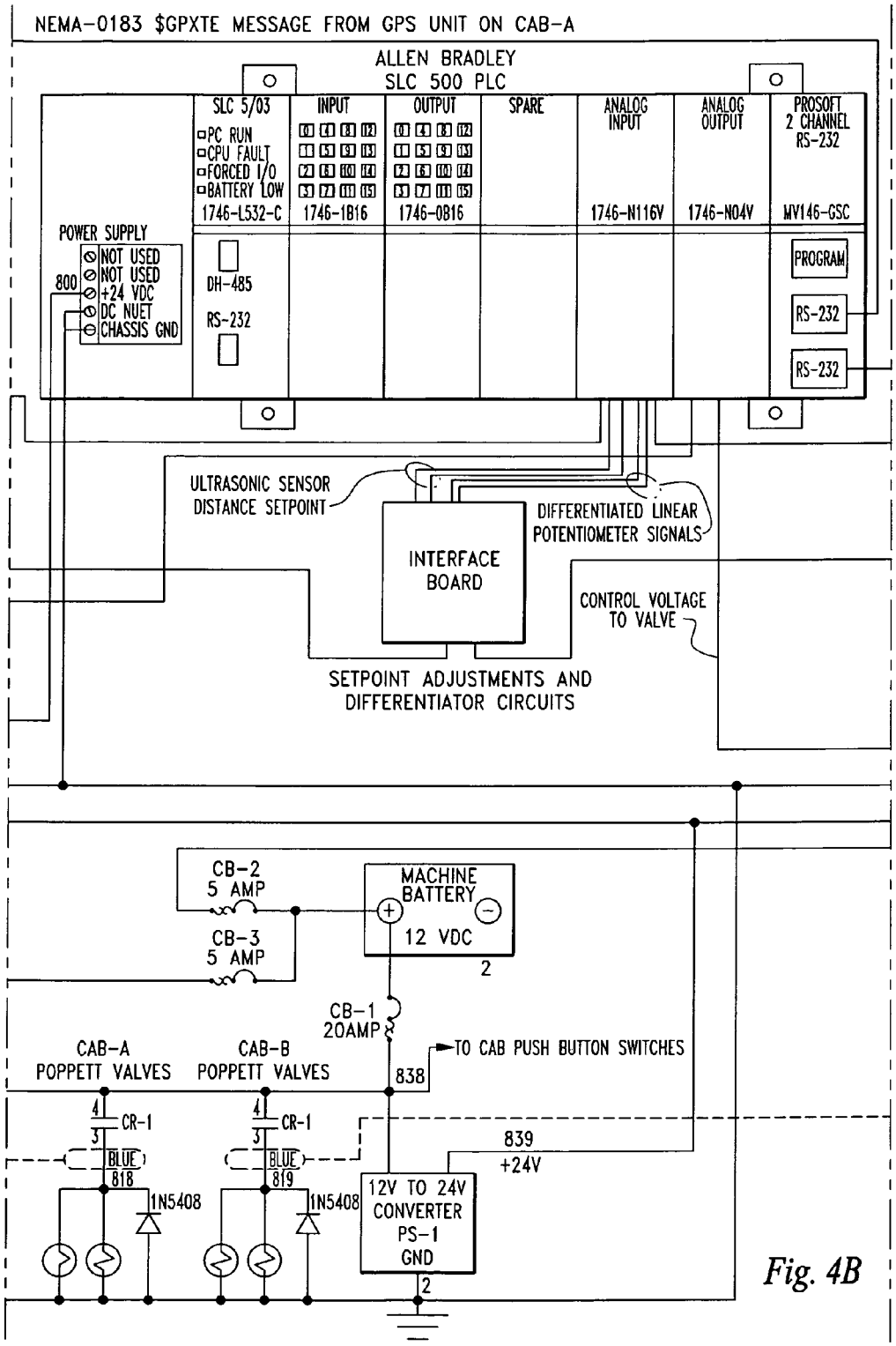
Figure 4C:
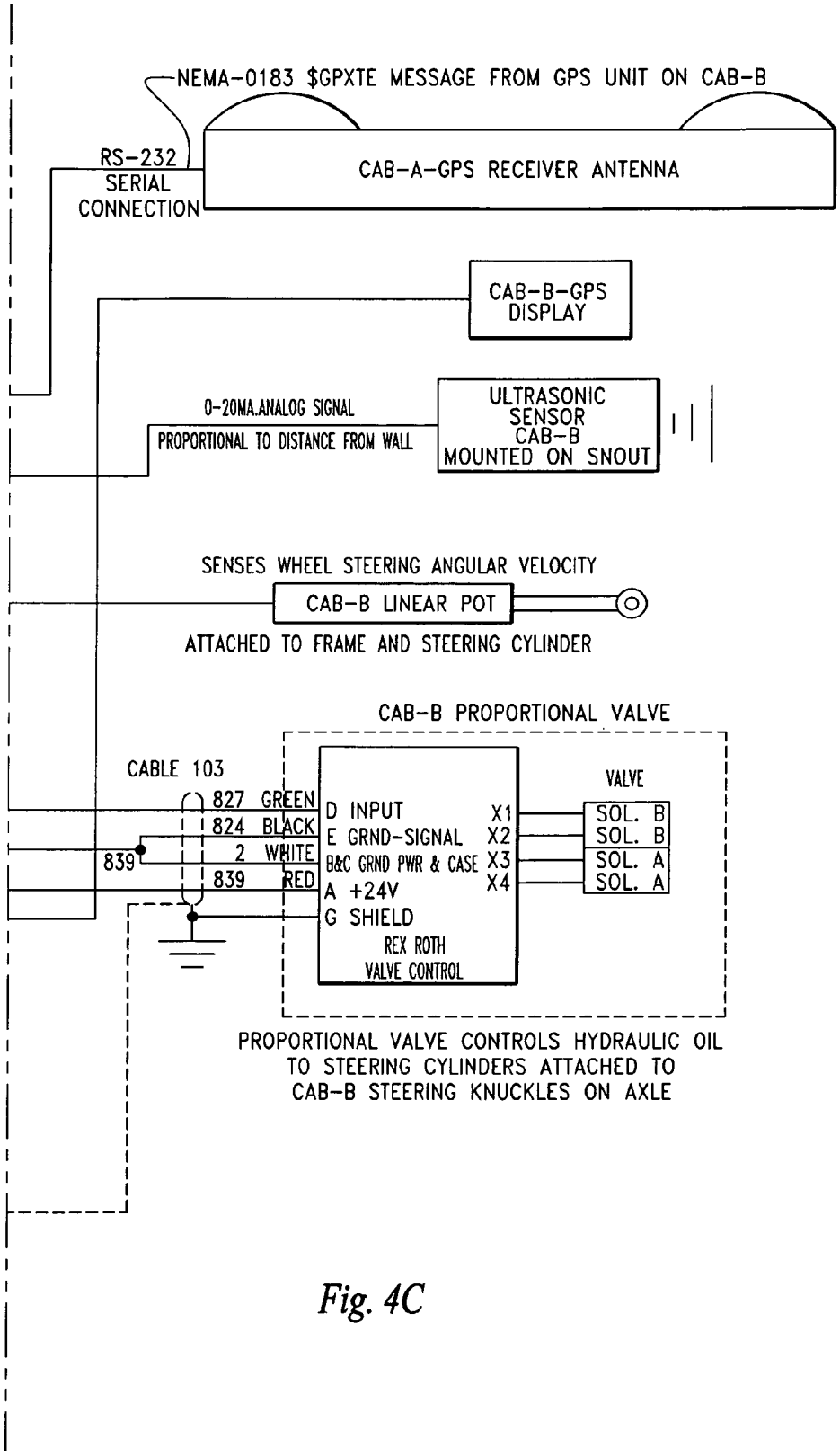

Machine 14 has wheels 22 at the leading end thereof and wheels 24 at the discharge end thereof. The pairs of front wheels 22 and rear wheels 24 are independently steerable, the wheel pairs being supported by independent wheel support systems 26, 28 (see FIG. 3) of any suitable type. Steering may be accomplished through utilization of hydraulic proportional valves 30. The hydraulic proportional valves 30 are operatively associated with different steering controls which may suitably be located in a single module 34 as shown in FIG. 3. Reference may also be had to FIG. 4 for a complete disclosure of the steering control circuitry and structure and the relationship thereof to the wheel steering structure and other components of this invention, including sensors which will now be described.

An ultrasonic sensor 40 is mounted on machine 14 for sensing the location of the string of roadway barrier segments 12 at the front or leading end of the machine. In particular, the ultrasonic sensor 40 is located at a position forward of inlet 16 and may suitably be mounted on the snout forming the inlet. The ultrasonic sensor 40 is mounted horizontally and positioned to serially read the distance to a flat vertical face on the roadway barrier segments during movement of the wheeled machine along the string at the first or initial location of the string prior to transport and relocation by the machine. Reading of the distance to the flat vertical face on the head of each barrier segment is done before it is lifted by the conveyor system. The signal produced is compared with a reference signal and a PLC code processes this information and sends the required signals to the hydraulic proportional valves 30 that steer the wheels to keep the barrier centered relative to the inlet, thus steering the machine to follow the wall.

A second sensor, a GPS unit, receives a signal from a satellite system 42 via an antenna 44 mounted on the machine. In the arrangement illustrated, a fixed base "RTK" (real time kinematics) unit 48 is used to provide corrective data from the GPS signal to another antenna 50 on the machine.

The GPS unit has a message output in ASCII format that contains the Cross Track Error information. This error signal represents how far the machine is from the recorded path or the plotted path, at a ninety degree angle. This signal is mixed with a differentiated feedback signal representing the wheel angle motion and processed by a PLC code. The result is sent to the proportional hydraulic valves that steer the wheels to keep the machine on the expected path.

The systems work independently to provide the guidance for picking up existing roadway barrier segments and placing them precisely and consistently. The system permits the machine operator or operators to place the barrier in the exact position every transfer without manual inputs to the steering. The system also avoids use of any infrastructure modifications such as above or below grade guide wires or magnetic tape.

To enable the apparatus to reverse direction to return the roadway barrier segments to the original position the antenna (GPS) and ultrasonic sensors would be replicated on both ends of the machine. FIGS. 2 and 3, for example, show the ultrasonic sensors 40 projecting from both ends.

The invention claimed is:

1. Apparatus for moving relative to a string of roadway barrier segments disposed end-to-end at a first location and during said movement serially picking up roadway barrier segments of said string and transporting the picked-up roadway barrier segments to relocate the string at a second location, said apparatus comprising in combination:

a wheeled machine having an inlet receiving said string of roadway barrier segments at said first location;

a first sensor mounted on said wheeled machine for sensing the location of said string at said first location relative to said wheeled machine;

a first steering control operatively associated with said first sensor and with wheels of said wheeled machine to steer the wheels operatively associated therewith and maintain said inlet positioned to serially receive said roadway barrier segments at said first location;

a second sensor mounted on said wheeled machine for sensing the location of the wheeled machine relative to a predetermined path of movement; and a second steering control operatively associated with said second sensor and with wheels of said wheeled machine to steer the wheels operatively associated therewith and maintain movement of said wheeled machine along said predetermined path of movement when depositing the picked-up barrier segments to relocate the string at said second location.

2. The apparatus according to claim 1 wherein said first sensor comprises an ultrasonic sensor.

3. The apparatus according to claim 2 wherein said ultrasonic sensor is located at a position forward of said inlet.

4. The apparatus according to claim 3 wherein said ultrasonic sensor is mounted horizontally and positioned to serially read the distance to a flat vertical face on the roadway barrier segments during movement of said wheeled machine along the string at the first location.

5. The apparatus according to claim 1 additionally including proportional hydraulic valve structure controlled by said first and second steering controls to steer the wheels operatively associated therewith.

6. The apparatus according to claim 1 wherein said second sensor is a GPS receiver.

7. The apparatus according to claim 1 wherein said first sensor comprises an ultrasonic sensor and said second sensor comprises a GPS receiver respectively sending guidance signals based on ultrasonic measurements from the roadway barrier segments and GPS guidance signals.

8. In a method of relocating a string of roadway barrier segments disposed end-to-end from a first location to a second location employing a moving wheeled machine having an inlet to serially pick up roadway barrier segments of said string and transport the picked-up roadway barrier segments to relocate the string at the second location, the additional steps of:

utilizing a first sensor mounted on said wheeled machine during movement of said wheeled machine to sense the location of said string at said first location relative to said wheeled machine;

employing a first steering control operatively associated with said first sensor and with wheels of said wheeled machine to steer the wheels operatively associated therewith and maintain said inlet positioned to serially receive said roadway barrier segments at said first location during movement of said wheeled machine;

utilizing a second sensor mounted on said wheeled machine during movement thereof for sensing the location of the wheeled machine relative to a predetermined path of movement; and employing a second steering control operatively associated with said second sensor and with wheels of said wheeled machine to steer the wheels operatively associated therewith and maintain movement of said wheeled machine along said predetermined path of movement when depositing the picked-up barrier segments to relocate the string at said second location.

9. The method according to claim 8 wherein said first sensor comprises an ultrasonic sensor.

10. The method according to claim 9 wherein said ultrasonic sensor is located at a position forward of said inlet.

11. The method according to claim 10 wherein said ultrasonic sensor is mounted horizontally and positioned to serially read the distance to a flat vertical face on the roadway barrier segments during movement of said wheeled machine along the string at the first location.

12. The method according to claim 8 additionally including the step of employing proportional hydraulic valve structure controlled by said first and second steering controls to steer the wheels operatively associated therewith.

13. The apparatus according to claim 8 wherein said second sensor is a GPS receiver.

14. The apparatus according to claim 8 wherein said first sensor comprises an ultrasonic sensor and said second sensor comprises a GPS receiver respectively sending guidance signals based on ultrasonic measurements from the roadway barrier segments and GPS guidance signals.

* * * * *